US010532591B2

(12) United States Patent
Ueno et al.

(10) Patent No.: US 10,532,591 B2
(45) Date of Patent: Jan. 14, 2020

(54) CLOTH HOLDER STACKER, FABRIC PRINTING APPARATUS, AND HEATING DEVICE

(71) Applicant: Ricoh Company, Ltd., Tokyo (JP)

(72) Inventors: Satoshi Ueno, Tokyo (JP); Yoshinori Uchino, Kanagawa (JP); Tsuyoshi Miyata, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 22 days.

(21) Appl. No.: 15/814,460

(22) Filed: Nov. 16, 2017

(65) Prior Publication Data

US 2018/0154656 A1 Jun. 7, 2018

(30) Foreign Application Priority Data

Dec. 6, 2016 (JP) ..... 2016-236442
Oct. 24, 2017 (JP) ..... 2017-204937

(51) Int. Cl.

| | |
|---|---|
| ***B41J 11/58*** | (2006.01) |
| ***B41J 11/00*** | (2006.01) |
| ***B41J 3/407*** | (2006.01) |
| *D06P 5/30* | (2006.01) |

(52) U.S. Cl.

CPC ..... *B41J 11/58* (2013.01); *B41J 3/4078* (2013.01); *B41J 11/002* (2013.01); *B41J 11/007* (2013.01); *D06P 5/30* (2013.01)

(58) Field of Classification Search

CPC ..... B41J 11/002; B41J 11/06; B41J 3/4078; B41J 11/58; B41J 11/007; D06P 5/30

See application file for complete search history.

(56) References Cited

U.S. PATENT DOCUMENTS

2013/0278698 A1* 10/2013 Takeuchi ..... B41J 13/10 347/104
2017/0136784 A1 5/2017 Ueno
2017/0320316 A1 11/2017 Nakamura et al.
2017/0320339 A1 11/2017 Matsumoto et al.

FOREIGN PATENT DOCUMENTS

JP 2009-056377 3/2009
JP 2013-096017 5/2013
JP 2015-218418 12/2015

* cited by examiner

*Primary Examiner* — Henok D LeGesse
(74) *Attorney, Agent, or Firm* — Xsensus LLP

(57) ABSTRACT

A cloth holder stacker includes a first cloth holder and a second cloth holder. The first cloth holder includes a first base including a first bottom, a first platen to hold a first cloth, and a first clearance former mounted on the first bottom of the first base. The second cloth holder includes a second base including a second bottom, a second platen to hold a second cloth, and a second clearance former mounted on the second bottom of the second base. The second clearance former defines a clearance between the second bottom of the second base and the first cloth held by the first cloth holder when the second cloth holder is stacked on the first cloth holder.

14 Claims, 11 Drawing Sheets

CLOTH HOLDER STACKER, FABRIC PRINTING APPARATUS, AND HEATING DEVICE

CROSS-REFERENCE TO RELATED APPLICATIONS

This patent application is based on and claims priority pursuant to 35 U.S.C. § 119 to Japanese Patent Application Nos. 2016-236442, filed on Dec. 6, 2016, and 2017-204937, filed on Oct. 24, 2017, in the Japanese Patent Office, the entire disclosure of each of which is hereby incorporated by reference herein.

BACKGROUND

Technical Field

Exemplary aspects of the present disclosure relate to a cloth holder stacker, a fabric printing apparatus, and a heating device, and more particularly, to a cloth holder stacker for holding fabric, a fabric printing apparatus for printing an image on fabric, and a heating device for heating the image on the fabric.

Description of the Background

Related-art fabric printing apparatuses, such as a fabric printer, print on fabric including manufactured products such as a T-shirt. The fabric printer includes a support device or a palette that stretches and holds fabric (e.g., a cloth), onto which an image is formed, to be planar.

The fabric printer may use a plurality of cassettes mounting a plurality of clothes, respectively, that is replaced successively, to print on the clothes continuously.

However, if the plurality of cassettes is stacked vertically to save space, an upper cassette may crease the cloth on a lower cassette. If the plurality of cassettes is aligned horizontally, the cassettes may occupy substantial space.

SUMMARY

This specification describes below an improved cloth holder stacker. In one embodiment, the cloth holder stacker includes a first cloth holder and a second cloth holder. The first cloth holder includes a first base including a first bottom, a first platen to hold a first cloth, and a first clearance former mounted on the first bottom of the first base. The second cloth holder includes a second base including a second bottom, a second platen to hold a second cloth, and a second clearance former mounted on the second bottom of the second base. The second clearance former defines a clearance between the second bottom of the second base and the first cloth held by the first cloth holder when the second cloth holder is stacked on the first cloth holder.

This specification further describes an improved fabric printing apparatus. In one embodiment, the fabric printing apparatus includes a body, a first cloth holder, a second cloth holder, and a receiver. The first cloth holder includes a first base including a first bottom, a first platen to hold a first cloth, and a first clearance former mounted on the first bottom of the first base. The second cloth holder is replaceable with the first cloth holder. The second cloth holder includes a second base including a second bottom, a second platen to hold a second cloth, and a second clearance former mounted on the second bottom of the second base. The second clearance former defines a clearance between the second bottom of the second base and the first cloth held by the first cloth holder when the second cloth holder is stacked on the first cloth holder. The receiver is disposed inside the body to removably receive the first cloth holder and the second cloth holder replaced with the first cloth holder.

This specification further describes an improved heating device. In one embodiment, the heating device heats a cloth bearing an image printed by a fabric printing apparatus. The heating device includes a body, a first cloth holder, a second cloth holder, and a receiver. The first cloth holder includes a first base including a first bottom, a first platen to hold a first cloth, and a first clearance former mounted on the first bottom of the first base. The second cloth holder is replaceable with the first cloth holder. The second cloth holder includes a second base including a second bottom, a second platen to hold a second cloth, and a second clearance former mounted on the second bottom of the second base. The second clearance former defines a clearance between the second bottom of the second base and the first cloth held by the first cloth holder when the second cloth holder is stacked on the first cloth holder. The receiver is disposed inside the body. The receiver removably receives the first cloth holder and the second cloth holder replaced with the first cloth holder.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
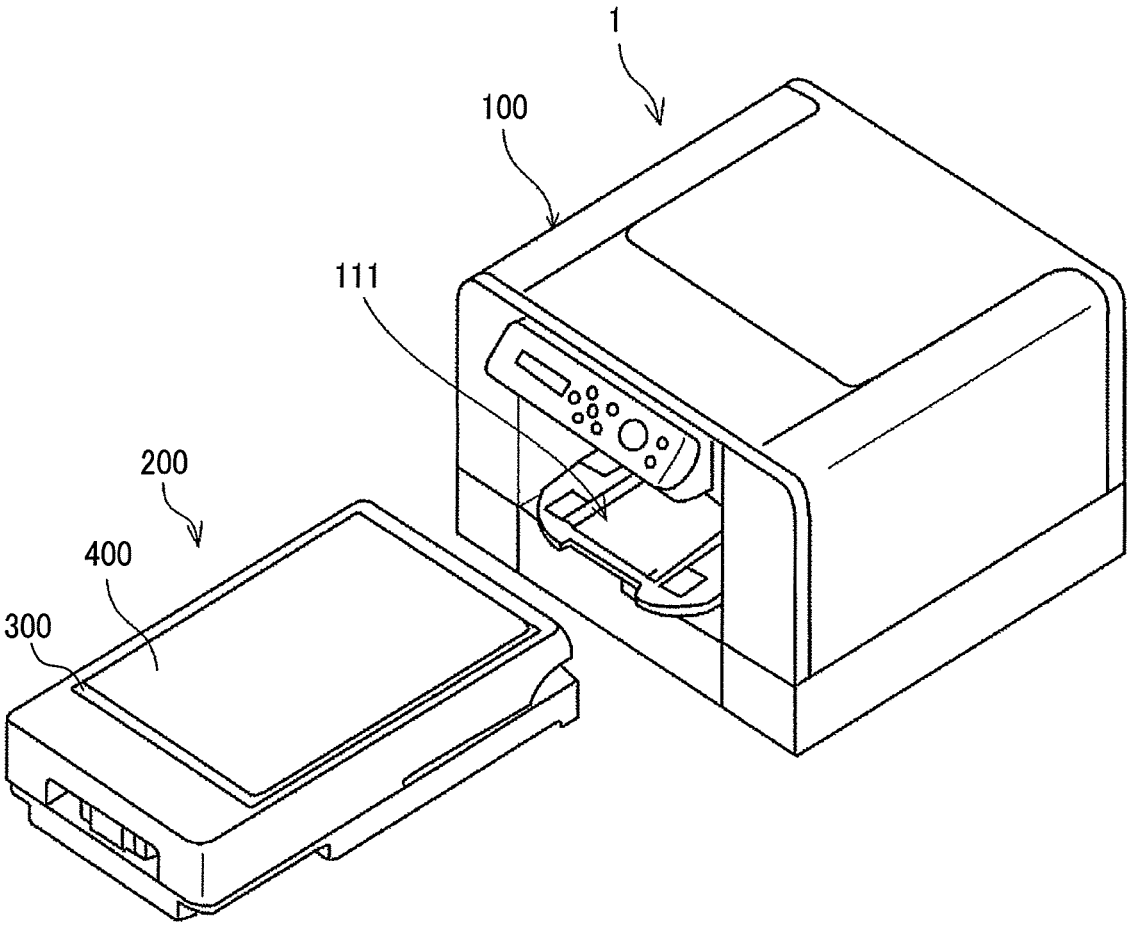
FIG. 1 is an external perspective view of a printer according to an embodiment of the present disclosure, illustrating a cassette removed from the printer.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, a printer 1 according to an embodiment is explained.

Referring now to the drawings, wherein like reference numerals designate identical or corresponding parts throughout the several views, embodiments of the present disclosure are described below.

Referring to FIGS. 1 to 4, a description is provided of one example of a construction of the printer 1 according to a first embodiment of the present disclosure.

Figure 2:
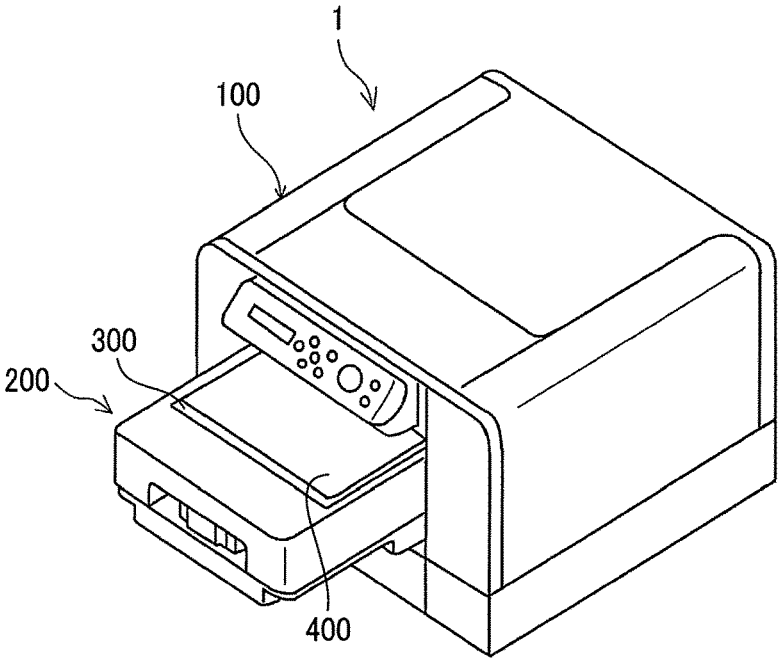
FIG. 2 is an external perspective view of the printer depicted in FIG. 1 attached with the cassette.
Figure 3:
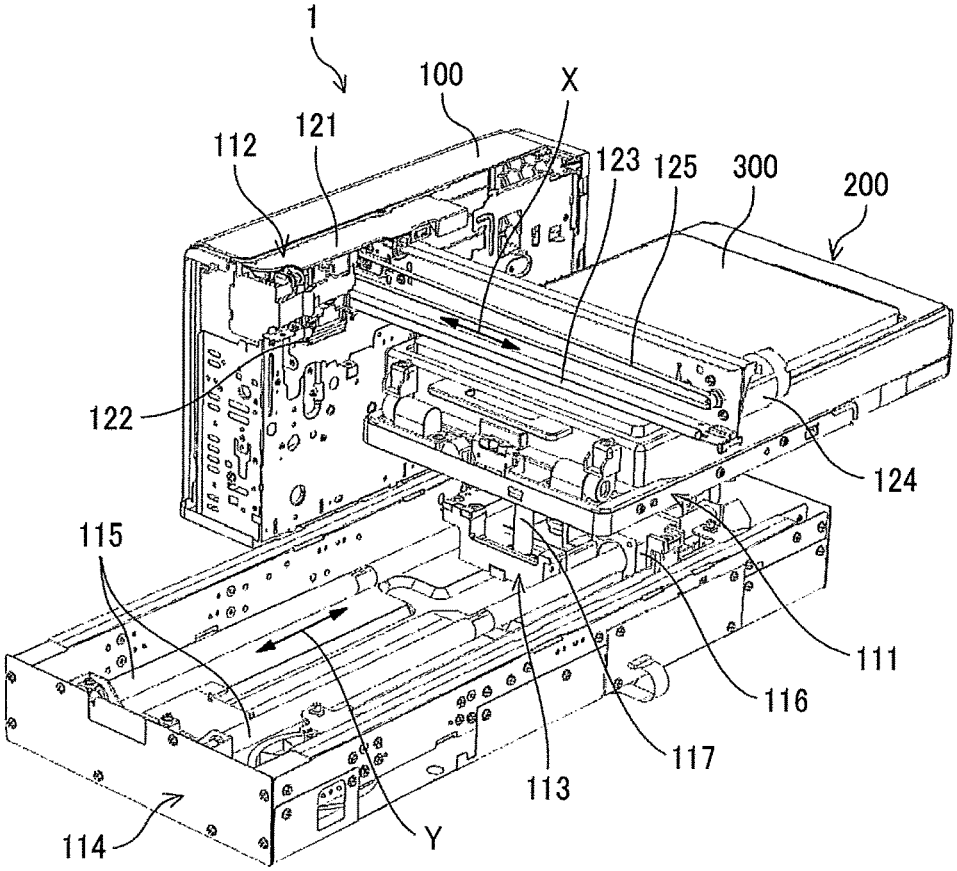
FIG. 3 is an internal perspective view of the printer depicted in FIG. 2, illustrating an entire mechanical section thereof seen from a first direction.
Figure 4:
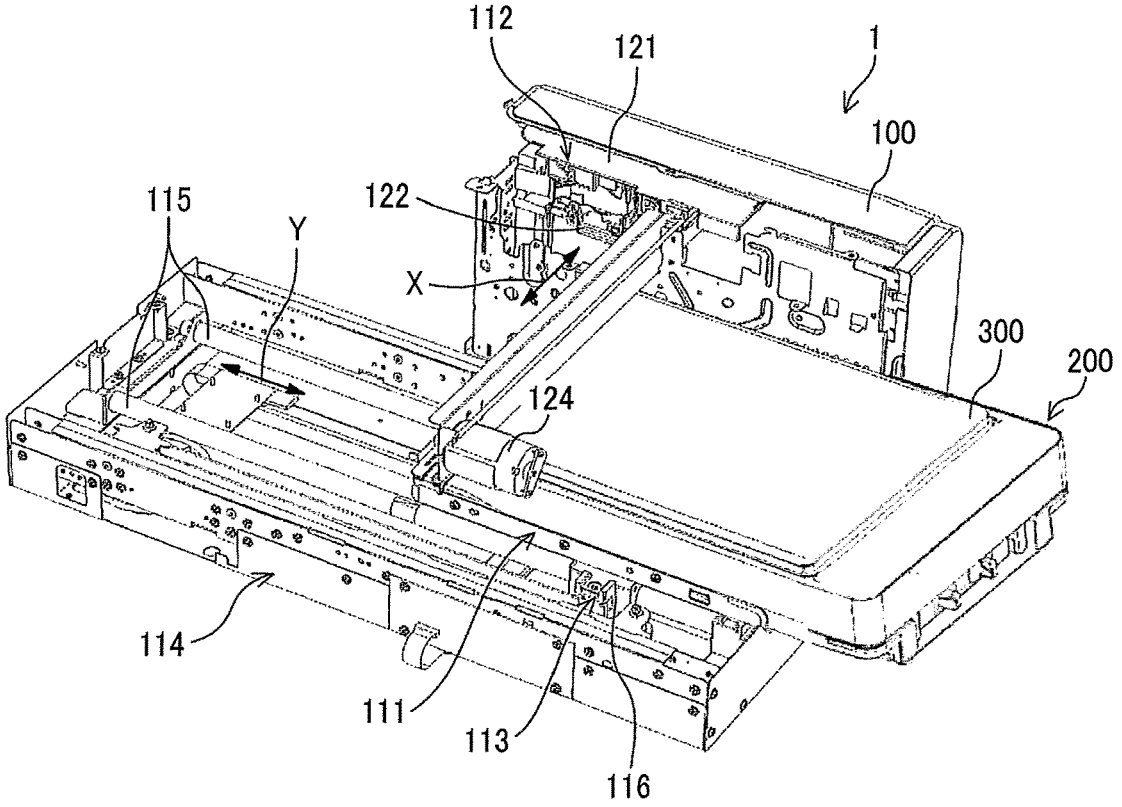
FIG. 4 is an internal perspective view of the printer depicted in FIG. 3, illustrating the entire mechanical section thereof seen from a second direction different from the first direction in FIG. 3.

The printer 1 is a fabric printer serving as a fabric printing apparatus that prints on fabric. FIG. 1 is an external perspective view of the printer 1 and a cassette 200 removed from the printer 1. FIG. 2 is an external perspective view of the printer 1 attached with the cassette 200. FIG. 3 is an internal perspective view of the printer 1, illustrating an entire mechanical section thereof seen from a first direction. FIG. 4 is an internal perspective view of the printer 1, illustrating the entire mechanical section thereof seen from a second direction different from the first direction in FIG. 3.

As illustrated in FIGS. 1 to 4, the printer 1 (e.g., a garment printer) serving as a fabric printing apparatus includes a body 100. Inside the body 100 are the cassette 200, a stage 111, and a printing device 112. As illustrated in FIG. 1, the cassette 200 serving as a cloth holder is a tray that holds a cloth 400. The stage 111 serves as a receiver that removably holds the cassette 200 and is movable back and forth. As illustrated in FIG. 3, the printing device 112 prints an image on the cloth 400 set on the cassette 200 held by the stage 111.

For example, the cloth 400 includes a piece of cloth such as a handkerchief and towel, a fabric manufactured as clothes such as a T-shirt and a sweatshirt, and a fabric used as a part of a product such as a tote bag.

As illustrated in FIG. 3, the stage 111 is disposed above a conveyer 113 movably supported by the body 100 such that the conveyer 113 is movable in a direction Y in a feed direction. The body 100 includes a bottom frame 114 that mounts a conveyance guide 115 along the direction Y. The conveyance guide 115 movably supports a slider 116 of the conveyer 113. The stage 111 is disposed on the conveyer 113 through a rod 117 that lifts and lowers the stage 111. Thus, a gap between the stage 111 and a head 122 of the printing device 112 is adjusted.

The printing device 112 includes a carriage 121 and the head 122. The carriage 121 moves relative to the stage 111 in a direction X, that is, a main scanning direction. The head 122 is mounted on the carriage 121. The carriage 121 is movably supported by a guide 123 extending in the direction X. A driving motor 124 reciprocally moves the carriage 121 in the direction X via a main scanning mechanical section such as a timing belt 125. The head 122 is a liquid discharge head that discharges ink onto a surface of the cloth 400 to form an image on the cloth 400. Alternatively, other types of heads may be employed as the head 122.

The cassette 200 includes a platen 300 on which the cloth 400 is set. The cassette 200 mounting the cloth 400 is attached to the stage 111 that holds the cassette 200 inside the body 100. As the stage 111 moves in the direction Y and the head 122 reciprocally moves in the direction X repeatedly, the head 122 prints a desired image on the cloth 400.

Figure 5:
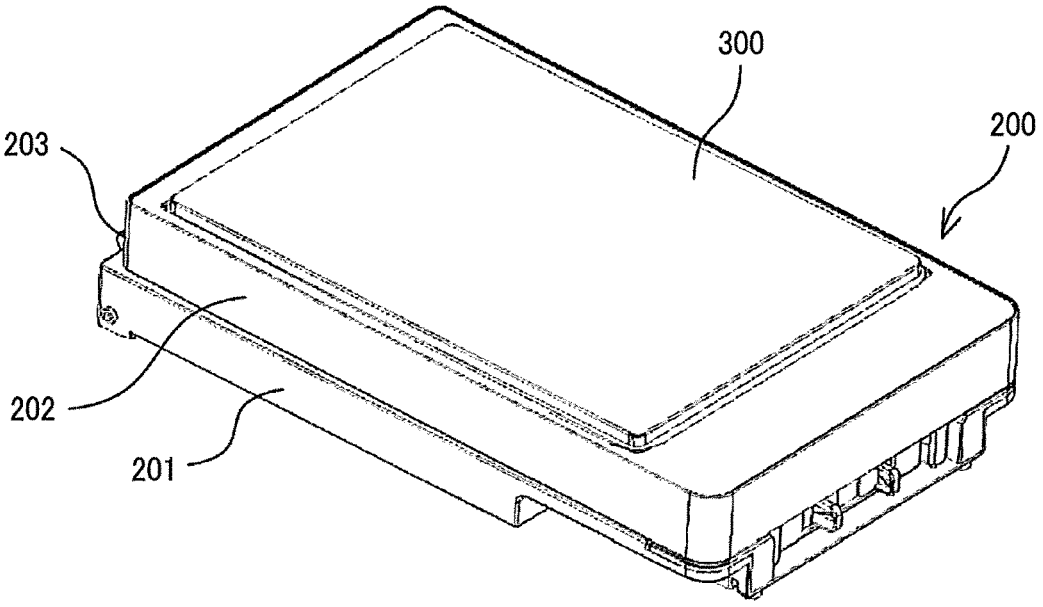
FIG. 5 is a perspective view of the cassette depicted in FIG. 1.
Figure 6:
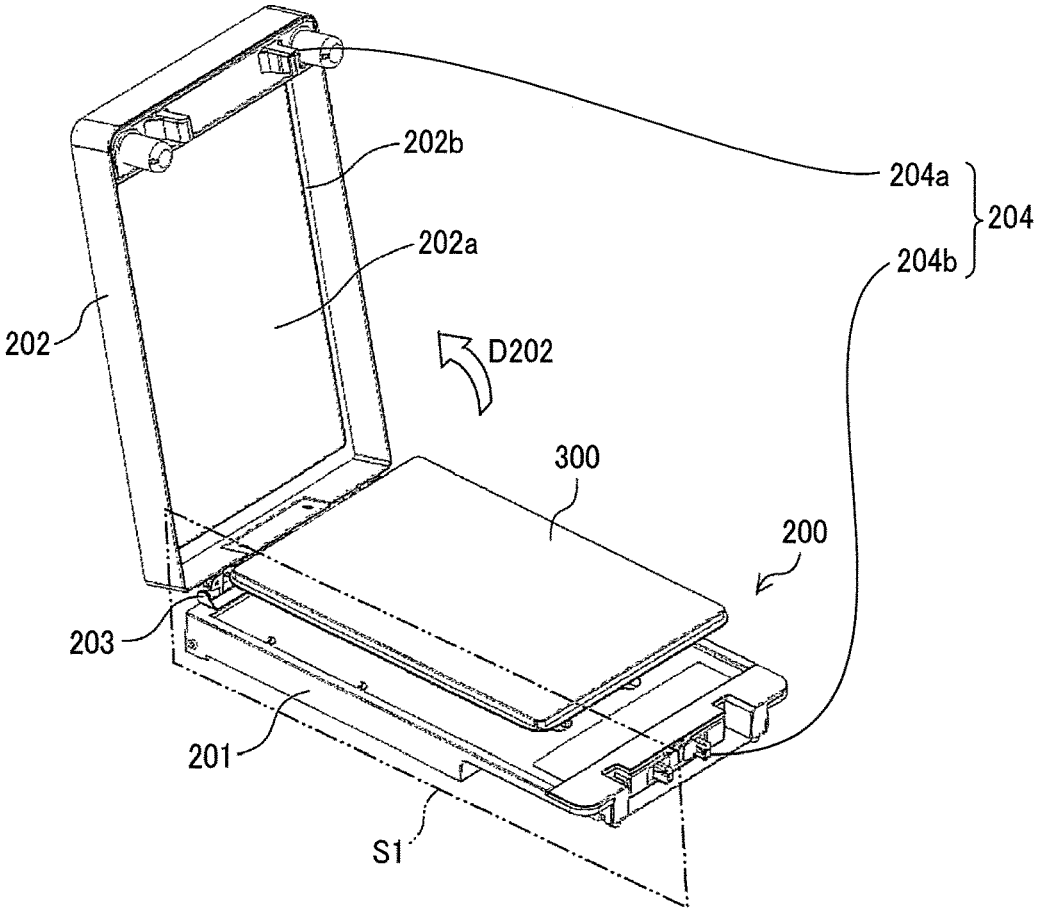
FIG. 6 is a perspective view of the cassette depicted in FIG. 5, illustrating a platen flange cover that is lifted.
Figure 7:
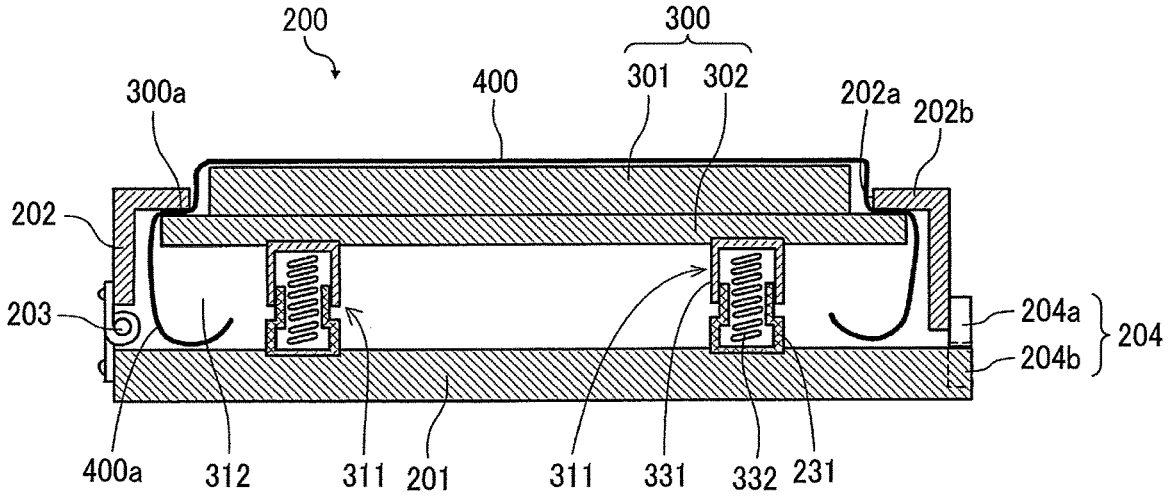
FIG. 7 is a schematic cross-sectional view of the cassette depicted in FIG. 5 in a longitudinal direction thereof taken on a cross-section in FIG. 6.

Referring to FIGS. 5 to 7, a description is provided of a construction of the cassette 200 (e.g., a tray) serving as a cloth holder.

FIG. 5 is a perspective view of the cassette 200. FIG. 6 is a perspective view of the cassette 200, illustrating a platen flange cover 202 that is lifted. FIG. 7 is a schematic cross-sectional view of the cassette 200 in a longitudinal direction thereof taken on a cross-section S1 in FIG. 6.

As illustrated in FIG. 5, the cassette 200 includes a cassette base 201 serving as a base and the platen 300 that holds the cloth 400 and keeps a print portion of the cloth 400 where the image is printed to be planar.

As illustrated in FIG. 7, the platen 300 includes a platen base 302 and an insulator 301 that includes a mount face that mounts the cloth 400 and keeps the cloth 400 to be planar. The insulator 301 is resistant against heat generated by a heating device.

As illustrated in FIGS. 5 and 6, the cassette 200 includes the platen flange cover 202 and a hinge 203. One end of the platen flange cover 202 serving as a flange cover in the longitudinal direction of the cassette 200 is pivotally attached to the cassette base 201 through the hinge 203. Thus, as illustrated in FIG. 6, the platen flange cover 202 is lifted relative to the cassette base 201 in a direction D202.

As illustrated in FIG. 6, the platen flange cover 202 includes a frame **202*b* defining a slot 202*a*, that is, an opening, disposed opposite the platen 300. As illustrated in FIG. 7, the platen 300 includes a flange 300*a* disposed at a rim of the platen 300. The frame 202*b* of the platen flange cover 202 presses the cloth 400 against the flange 300*a* of the platen 300**.

A support 311 mounted on the cassette base 201 supports the platen 300. The platen 300 and the cassette base 201 define an accommodation chamber 312 (e.g., an accommodation space) that accommodates a surplus portion **400*a* of the cloth 400. For example, the surplus portion 400*a*** may be sleeves, a neck, a hem, and the like of a T-shirt, if an image is printed on a front of the T-shirt.

The platen 300 is removably attached to the cassette base 201 and is replaceable. Accordingly, a plurality of platens 300 may be used for printing. While a first platen 300 is used for a print job, a user wraps a cloth 400 (e.g., a garment) around a second platen 300 to be used for a next print job.

After the print job and a fixing job are finished, the first platen 300 is replaced with the second platen 300 to start the next print job quickly.

In order to set the cloth 400 on the cassette 200, the user lifts and opens the platen flange cover 202 as illustrated in FIG. 6 and places the cloth 400 on the platen 300. In a state in which the accommodation chamber 312 accommodates the surplus portion 400*a* of the cloth 400 as illustrated in FIG. 7, the user lowers and closes the platen flange cover 202 as illustrated in FIG. 5.

In order to print on the cloth 400, the user attaches or sets the cassette 200 mounting the cloth 400 to the stage 111 disposed inside the body 100 of the printer 1 as illustrated in FIG. 4.

As described above, the user removes the cassette 200 entirely from the body 100 and sets the cloth 400, onto which the image is to be printed, on the platen 300 readily.

After the printer 1 finishes printing on the cloth 400, the user moves the cassette 200 from the printer 1 to the heating device and sets the cassette 200 mounting the cloth 400 into the heating device. The heating device fixes the image on the cloth 400 under heat.

As illustrated in FIG. 7, the support 311 that supports the platen 300 includes a plurality of hollow columns 231 and 331 and a compression spring 332. The hollow column 231 is mounted on the cassette base 201. The hollow column 331 contacts the platen 300 and movably engages the hollow column 231. The compression spring 332 is disposed between or housed by the hollow columns 231 and 331.

Thus, the support 311 supports the platen 300 such that the platen 300 is displaceable or movable relative to the cassette base 201 serving as a base.

The platen flange cover 202 mounts a lock claw 204*a*. The lock claw 204*a* is disposed at another end of the platen flange cover 202 in the longitudinal direction of the cassette 200, which is opposite the one end of the platen flange cover 202, which is held by the hinge 203 about which the platen flange cover 202 is pivotable relative to the cassette base 201.

The cassette base 201 is provided with a lock claw holder 204*b* that releasably holds the lock claw 204*a*.

The lock claw 204*a* and the lock claw holder 204*b* construct a lock 204 that restricts the height of the platen flange cover 202 covering the flange 300*a* of the platen 300 relative to the cassette base 201.

Accordingly, when the thickness of the cloth 400 changes, the platen 300 lowers against a restoring force of the compression spring 332 to change a clearance between the platen 300 and the cassette base 201. Thus, the cassette 200 holds the clothes 400 of various thicknesses precisely.

Since the platen 300 is constantly pressed against the platen flange cover 202 with a constant force, even when the user carries the cassette 200, the cloth 400 does not shift or slip easily.

Additionally, even if the thickness of the cloth 400 changes, the platen 300 lowers to secure a clearance between the platen flange cover 202 and the platen 300. Accordingly, even if the thickness of the cloth 400 changes, the height of the platen flange cover 202 relative to the cassette base 201 does not change.

That is, the height of the surface of the cloth 400 held by the platen 300 is based on the height of the platen flange cover 202 relative to the cassette base 201.

A lock position where the lock 204 locks the platen flange cover 202 relative to the cassette base 201 is fixed, simplifying the construction of the cassette 200. Since the lock position does not change, the user operates the cassette 200 readily.

If a liquid discharge head is used as the head 122, as the distance from the head 122 to a surface of an object that receives liquid discharged from the head 122 decreases, the head 122 discharges the liquid onto the object more precisely to form an image with higher quality.

In this case, the platen 300 is displaceable and the flange 300*a* of the platen 300 is pressed against the platen flange cover 202. Accordingly, even if the thickness of the cloth 400 changes, the platen flange cover 202 restricts the height of the surface of the cloth 400, improving quality of the image formed on the cloth 400.

If the platen 300 is configured to be displaceable or movable, in order to retain parallelism between a surface of the platen 300 and a surface of the head 122 as it moves, the support 311 preferably supports the platen 300 at the flange 300*a* of the platen 300. However, the support 311 may make it difficult for the accommodation chamber 312 to accommodate the surplus portion 400*a* of the cloth 400.

To address this circumstance, the height of the platen flange cover 202 defines the height of the surface of the cloth 400 held by the platen 300, allowing the support 311 to contact an inward portion of the platen 300 and decreasing the number of the supports 311. Accordingly, the accommodation chamber 312 accommodates the surplus portion 400*a* of the cloth 400 readily.

A description is provided of a construction of a comparative fabric printer that prints on fabric including manufactured products such as a T-shirt.

The comparative fabric printer includes a support device or a palette that stretches and holds a cloth to be planar.

For example, the support device, which supports the cloth onto which an image is formed, includes a holder, a base, and a print face former. The holder is inserted into a tubular body formed by the cloth to hold the cloth. The holder fits in the base in a state in which the holder holds the cloth. The print face former is disposed on at least one of the holder and the base. The print face former defines a print face of the cloth onto which ink is discharged in a state in which the holder fits in the base. A plurality of palettes mounting a plurality of clothes, respectively, is aligned on a plane and conveyed.

In order to print on the plurality of clothes, a plurality of cloth holders, for example, a plurality of cassettes, holds the plurality of clothes, respectively, such that one cloth used for a print job is replaceable with another cloth used for a next print job. The cassettes are attached to the comparative fabric printer successively for continuous printing.

However, if the plurality of cassettes, each of which holds the cloth, is stacked, an upper cassette may interfere with the cloth held by a lower cassette, creasing the cloth on the lower cassette. To address this circumstance, the plurality of cassettes that holds the clothes, respectively, is aligned on the plane. Accordingly, the comparative fabric printer may be upsized or a substantial space where the plurality of cassettes that holds the clothes, respectively, is prepared for coming print jobs may be secured.

Figure 8:
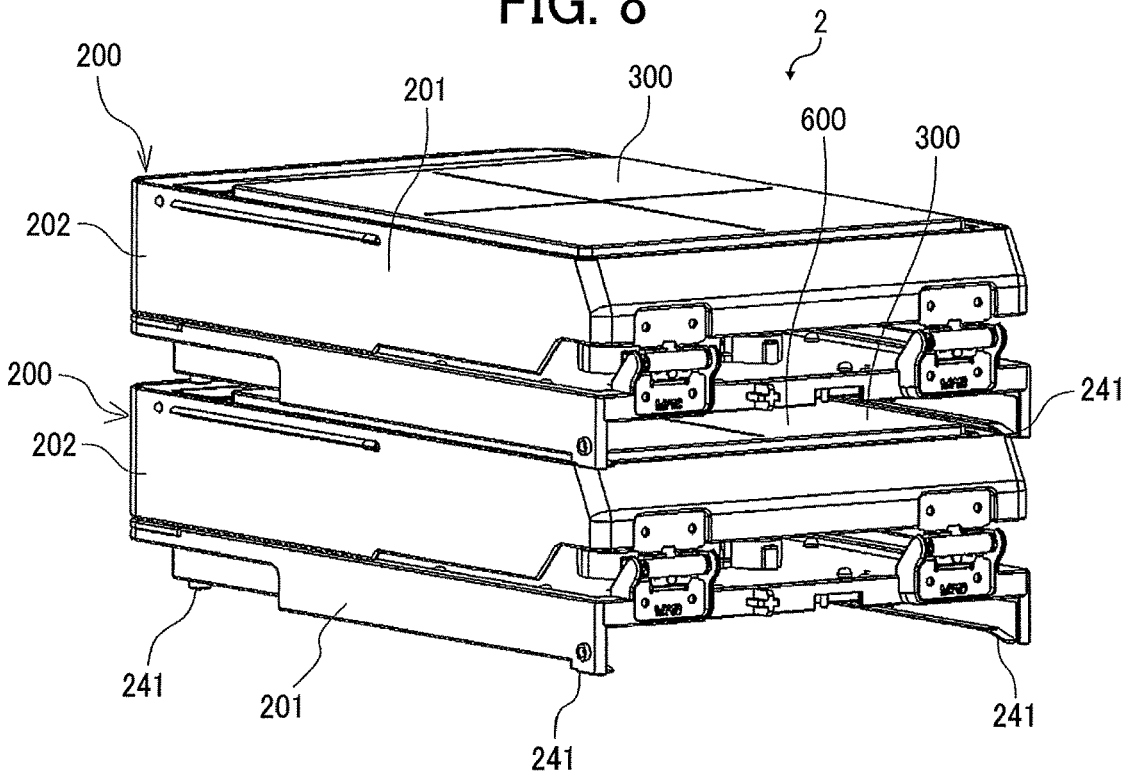
FIG. 8 is a perspective view of a cloth holder stacker including two cassettes according to a first embodiment, each of which is installable in the printer depicted in FIG. 1.
Figure 9:
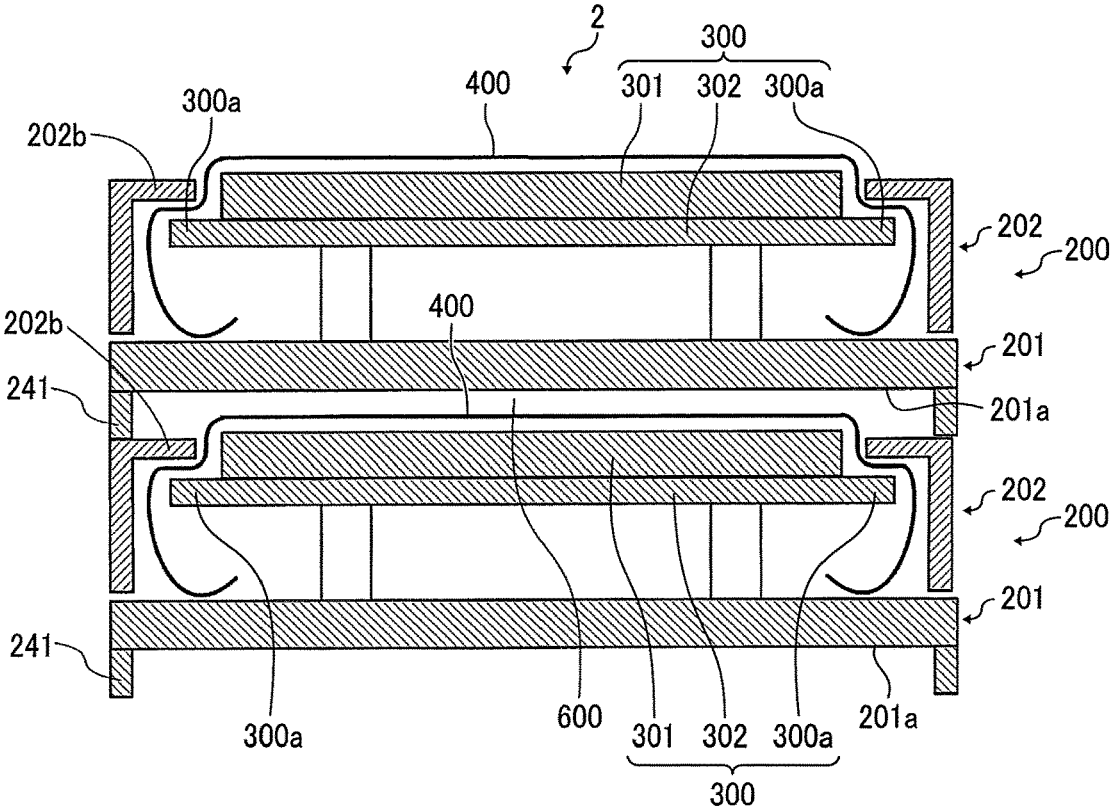
FIG. 9 is a cross-sectional view of the cloth holder stacker depicted in FIG. 8 in a short direction of the cassettes.

Referring to FIGS. 8 and 9, a description is provided of a construction of the cassette 200 serving as a cloth holder according to a first embodiment.

FIG. 8 is a perspective view of a cloth holder stacker 2 including the two cassettes 200, illustrating the lower cassette 200 and the upper cassette 200 stacked on the lower cassette 200. FIG. 9 is a cross-sectional view of the cloth holder stacker 2 in a short direction of the cassettes 200.

As illustrated in FIG. 9, a projection 241 is mounted on a bottom 201*a* of the cassette base 201 and serves as a clearance former that projects from the bottom 201*a* of the cassette base 201. When the upper cassette 200 serving as a second cloth holder is stacked on the lower cassette 200 serving as a first cloth holder, the projection 241 serving as a clearance former of the upper cassette 200 produces a clearance 600 between the cassette base 201 of the upper cassette 200 and the cloth 400 held by the platen 300 of the lower cassette 200.

According to the first embodiment, the projection 241 mounted on the cassette base 201 of the upper cassette 200 is placed on the platen flange cover 202 of the lower cassette 200. Alternatively, the projection 241 may be mounted on the platen flange cover 202 of the lower cassette 200 so that the cassette base 201 of the upper cassette 200 is placed on the projection 241 of the lower cassette 200.

Accordingly, even if the plurality of cassettes 200 is stacked in a state in which the cloth 400 is set on each of the cassettes 200, since the projections 241 serving as a clearance former produce the clearance 600 between the upper cassette 200 and the cloth 400 set on the lower cassette 200, the upper cassette 200 does not interfere with the cloth 400 set on the lower cassette 200.

Consequently, even if the plurality of cassettes 200, each of which mounts the cloth 400, is prepared for continuous printing in which the cassettes 200 are supplied and replaced successively, the plurality of cassettes 200 occupies a standby space equivalent to a flat area corresponding to the single cassette 200.

Hence, the printer 1 prints on the plurality of clothes 400 continuously in a small space.

The platen 300 projects beyond the platen flange cover 202.

Figure 10:
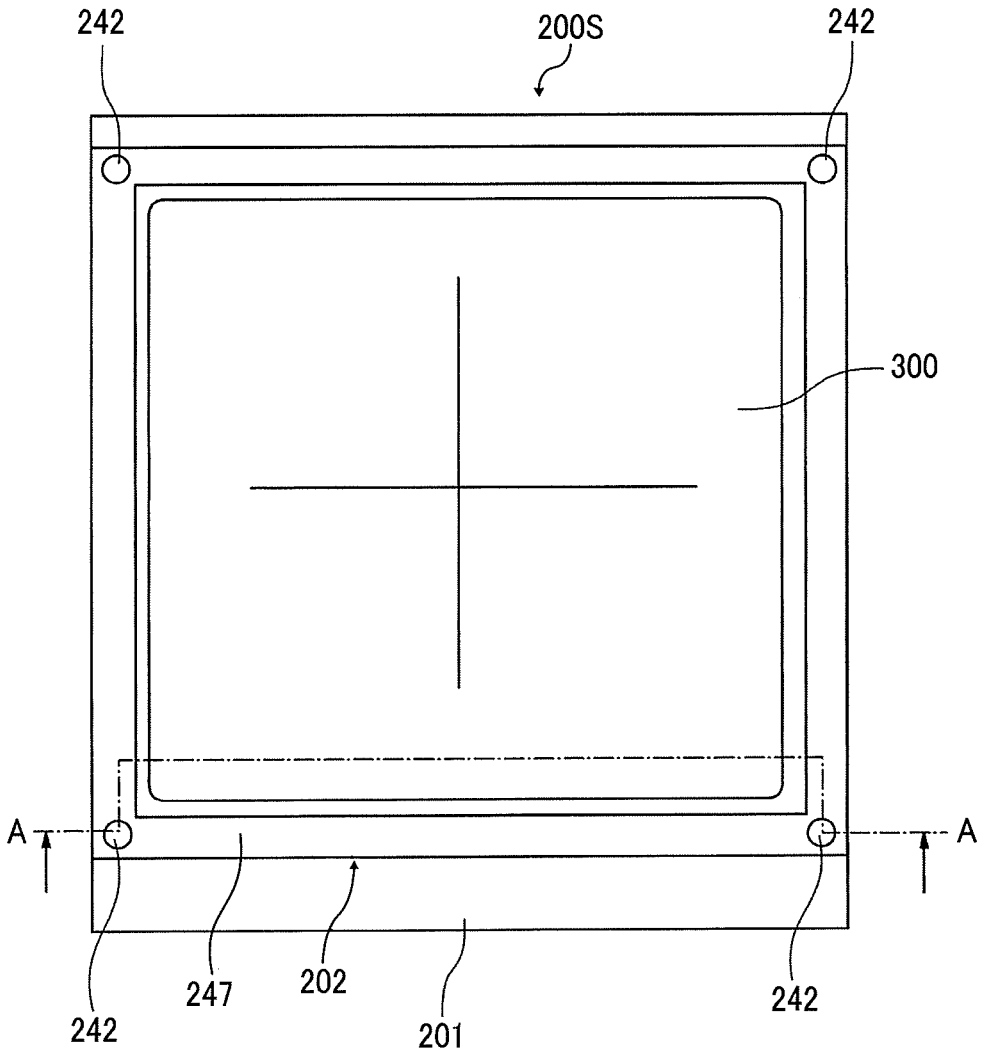
FIG. 10 is a plan view of a cassette according to a second embodiment, which is installable in the printer depicted in FIG. 1.
Figure 11:
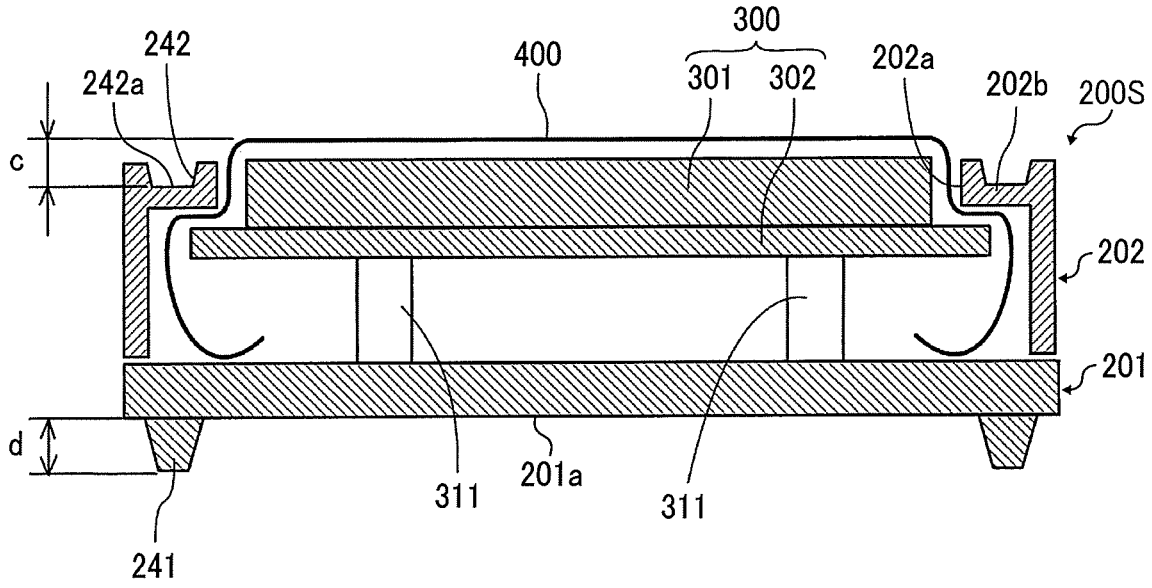
FIG. 11 is a cross-sectional view of the cassette depicted in FIG. 10 taken on line A-A in FIG. 10.

Referring to FIGS. 10 and 11, a description is provided of a construction of a cassette 200S serving as a cloth holder according to a second embodiment.

FIG. 10 is a plan view of the cassette 200S. FIG. 11 is a cross-sectional view of the cassette 200S taken on line A-A in FIG. 10.

As illustrated in FIG. 10, the cassette 200S includes four recesses 242 disposed at four corners on an upper face 247 of the platen flange cover 202. As illustrated in FIG. 11, when the upper cassette 200S is placed on the upper face 247 of the lower cassette 200S, the recesses 242 of the lower cassette 200S engage the projections 241 serving as a clearance former of the upper cassette 200S, respectively.

A height c defines a height from an interior bottom face 242*a* of the recess 242 in the platen flange cover 202 to the cloth 400 set on the platen 300. A height d defines a height, that is, an amount of projection, from a bottom face, that is, the bottom 201*a*, of the cassette base 201 to a bottom of the projection 241. The height c is smaller than the height d. Accordingly, when the upper cassette 200S is stacked on the lower cassette 200S, the height d of the projection 241 and the height c defined by a depth of the recess 242 define a clearance between the upper cassette 200S and the cloth 400 set on the lower cassette 200S.

When the upper cassette 200S is stacked on the lower cassette 200S, the projection 241 and the recess 242 restrict motion of the upper cassette 200S substantially horizontally, stabilizing stacking of the upper cassette 200S on the lower cassette 200S.

Figure 12A:
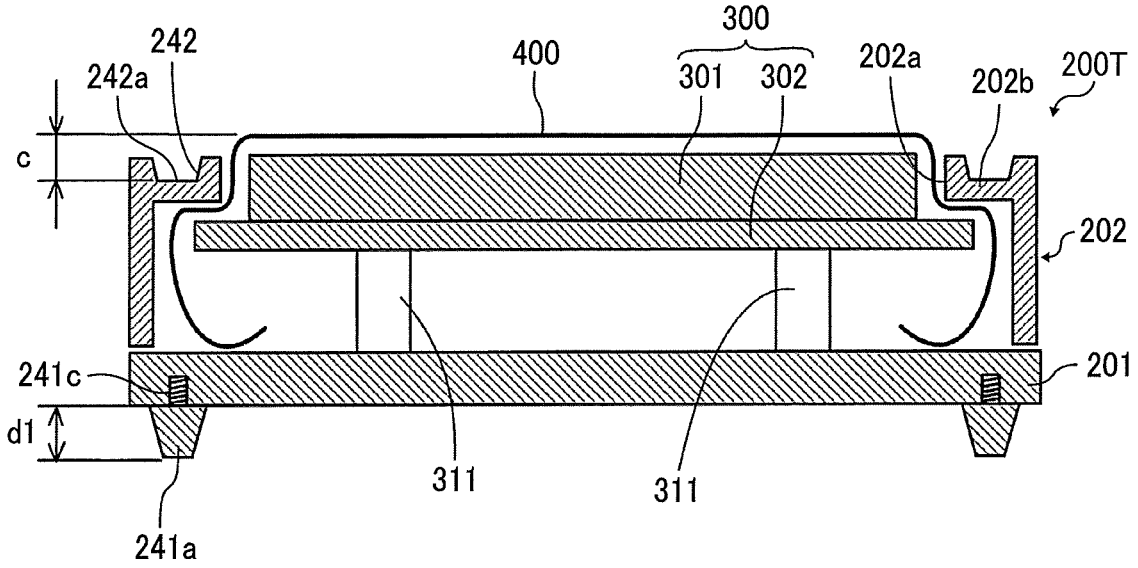
FIG. 12A is a cross-sectional view of a cassette according to a third embodiment, which is installable in the printer depicted in FIG. 1, illustrating a projection.
Figure 12B:
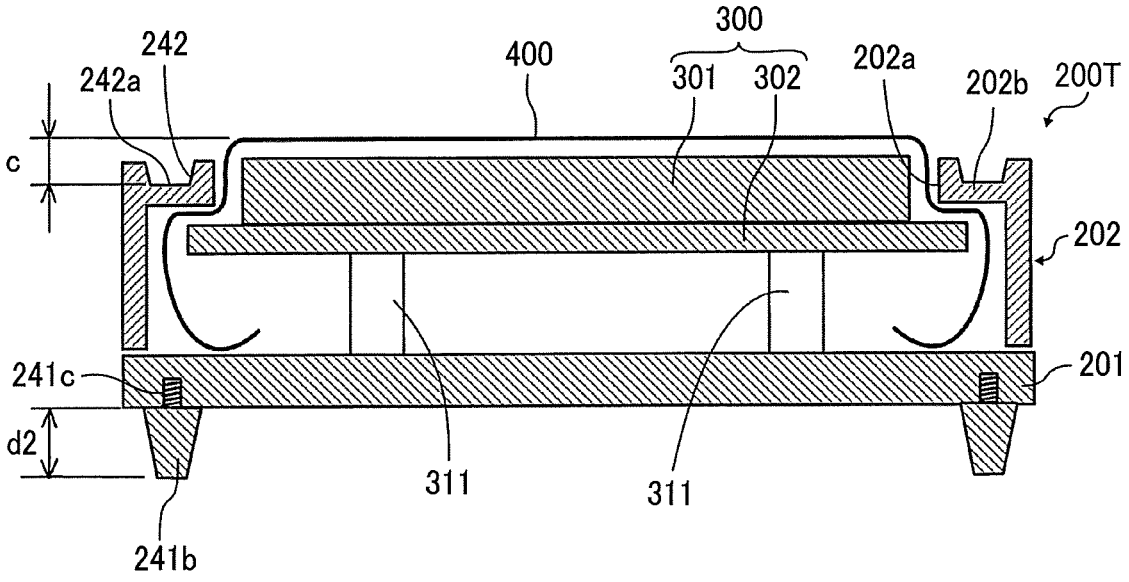
FIG. 12B is a cross-sectional view of the cassette depicted in FIG. 12A, illustrating another projection replaced with the projection depicted in FIG. 12A.

Referring to FIGS. 12A and 12B, a description is provided of a construction of a cassette 200T serving as a cloth holder according to a third embodiment.

FIG. 12A is a cross-sectional view of the cassette 200T in a short direction thereof, illustrating a projection 241*a*. FIG. 12B is a cross-sectional view of the cassette 200T in the short direction thereof, illustrating a projection 241*b*.

According to the third embodiment, the projection 241*a* depicted in FIG. 12A or the projection 241*b* depicted in FIG. 12B, each of which serves as a clearance former, is detachably attached to the cassette base 201 selectively. According to an example illustrated in FIGS. 12A and 12B, each of the projections 241*a* and 241*b* is fastened to the cassette base 201 with a screw 241*c*. The projection 241*a* has a height d1 that is greater than the height c from the interior bottom face 242*a* of the recess 242 in the platen flange cover 202 to the cloth 400 set on the platen 300. The projection 241*b* has a height d2 that is greater than the height c. The height d2 of the projection 241*b* is greater than the height d1 of the projection 241*a* Alternatively, each of the projections 241*a* and 241*b* may be fastened to the cassette base 201 in other methods.

Accordingly, even if the thickness of the cloth 400 held by the platen 300 varies, the projections 241*a* and 241*b* secure the clearance between the upper cassette 200T and the cloth 400 set on the platen 300 of the lower cassette 200T.

Figure 13:
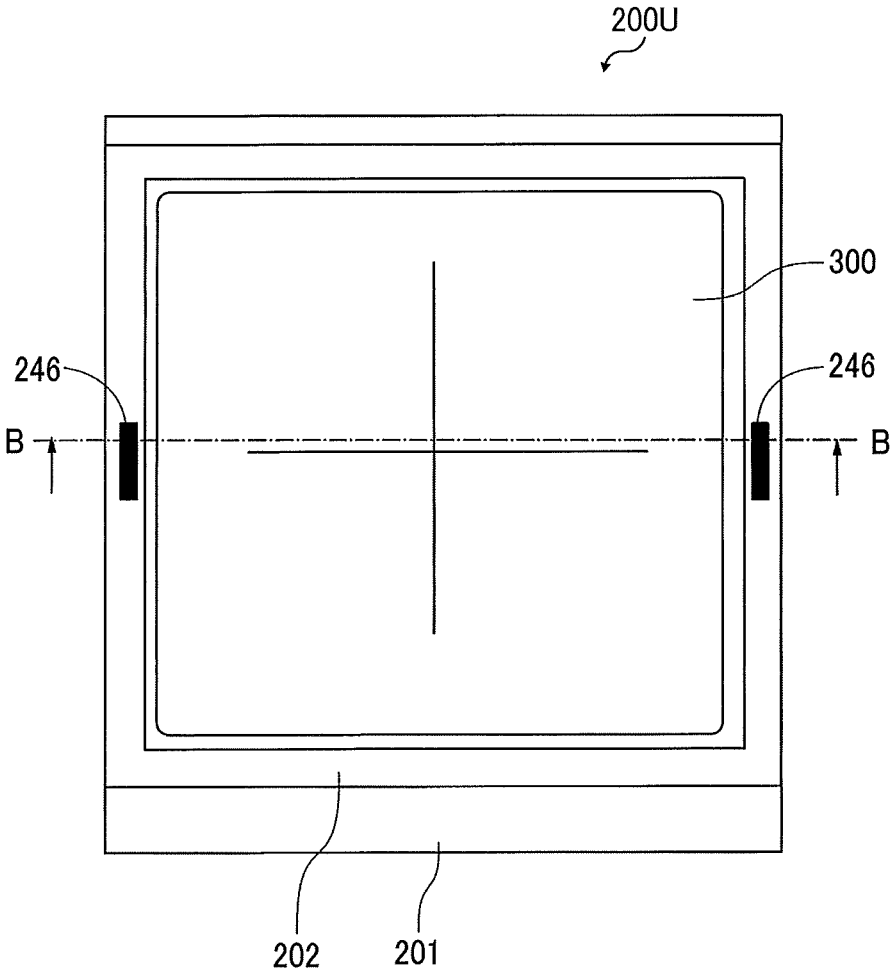
FIG. 13 is a plan view of a cassette according to a fourth embodiment, which is installable in the printer depicted in FIG. 1.
Figure 14:
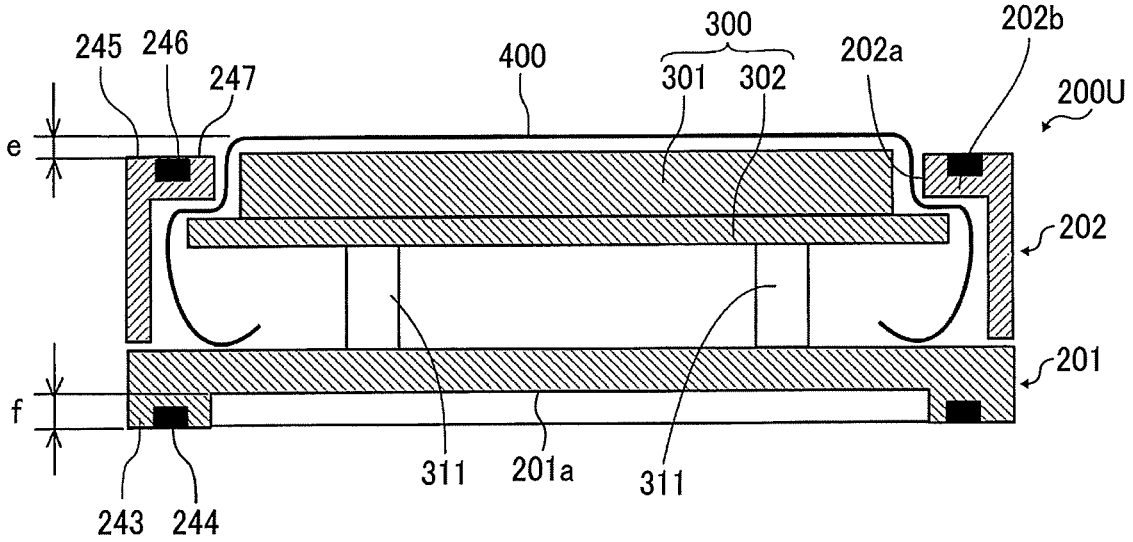
FIG. 14 is a cross-sectional view of the cassette depicted in FIG. 13 taken on line B-B in FIG. 13.

Referring to FIGS. 13 and 14, a description is provided of a construction of a cassette 200U serving as a cloth holder according to a fourth embodiment.

FIG. 13 is a plan view of the cassette 200U. FIG. 14 is a cross-sectional view of the cassette 200U taken on line B-B in FIG. 13.

As illustrated in FIG. 14, a plurality of clearance formers 243 is mounted on both lateral ends of the cassette base 201 in a short direction thereof, respectively, and extended in a longitudinal direction thereof. Each of the clearance formers 243 is embedded with a magnetic body 244 (e.g., a magnetic metal).

The platen flange cover 202 includes a mount 245 on which the clearance former 243 of the upper cassette 200U is placed. The mount 245 is embedded with a magnet 246 that magnetically attracts the magnetic body 244 embedded in the clearance former 243 mounted on the cassette base 201. Thus, the magnet 246 of the lower cassette 200U attracts the magnetic body 244 of the upper cassette 200U when the upper cassette 200U is stacked on the lower cassette 200U.

Alternatively, the cassette base 201 may be embedded with the magnet 246 and the platen flange cover 202 may be embedded with the magnetic body 244. Yet alternatively, each of the cassette base 201 and the platen flange cover 202 may be embedded with the magnet 246. However, if the cassette base 201 is embedded with the magnetic body 244, even if the lowermost cassette 200U is placed on a metallic mount, the lowermost cassette 200U is immune from being fixed on the metallic mount.

A height e defines a height from the upper face 247 of the platen flange cover 202 to the cloth 400 set on the platen 300. A height f defines a height, that is, an amount of projection, from the bottom 201*a* of the cassette base 201 to a bottom of the clearance former 243. The height e is smaller than the height f. Accordingly, when the upper cassette 200U is stacked on the lower cassette 200U, the height e smaller than the height f defines a clearance between the upper cassette 200U and the cloth 400 set on the lower cassette 200U.

When the upper cassette 200U is stacked on the lower cassette 200U, the magnet 246 of the lower cassette 200U and the magnetic body 244 of the upper cassette 200U restrict motion of the upper cassette 200U substantially horizontally, stabilizing stacking of the upper cassette 200U on the lower cassette 200U.

Figure 15:
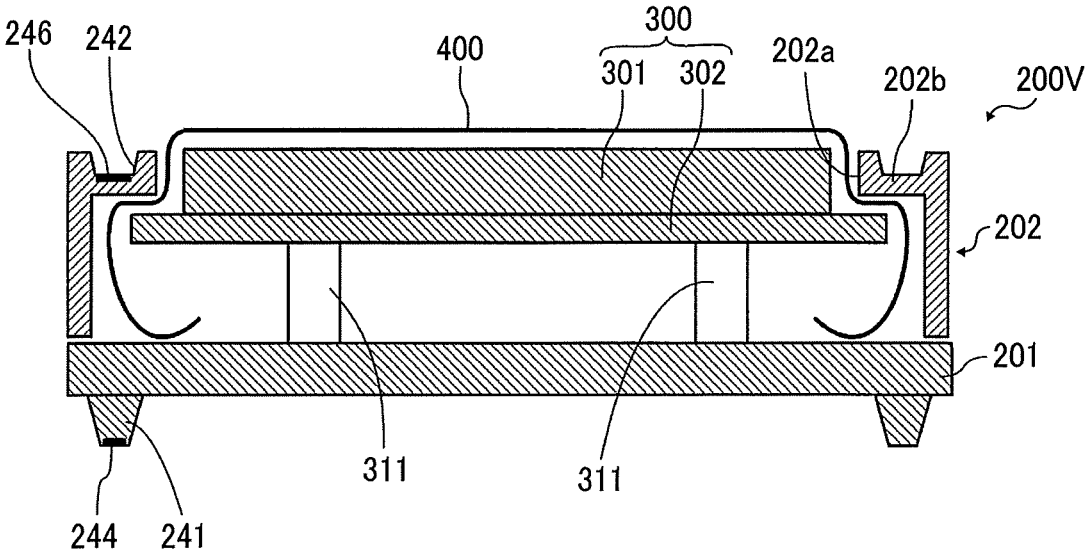
FIG. 15 is a cross-sectional view of a cassette according to a fifth embodiment, which is installable in the printer depicted in FIG. 1.

Referring to FIG. 15, a description is provided of a construction of a cassette 200V according to a fifth embodiment.

FIG. 15 is a cross-sectional view of the cassette 200V that is substantially equivalent to the cassette 200S depicted in FIG. 11.

The cassette 200V according to the fifth embodiment depicted in FIG. 15 is different from the cassette 200S according to the second embodiment depicted in FIG. 11 in that the projection 241 mounts the magnetic body 244 (e.g., a magnetic metal) and the recess 242 mounts the magnet 246 that magnetically attracts the magnetic body 244 mounted on the projection 241 of another cassette 200V.

Accordingly, when the upper cassette 200V is stacked on the lower cassette 200V, the projection 241 of the upper cassette 200V is secured to the recess 242 of the lower cassette 200V such that the upper cassette 200V is detachably attached to the lower cassette 200V in a stack direction, attaining stable stacking of the upper cassette 200V on the lower cassette 200V.

Figure 16:
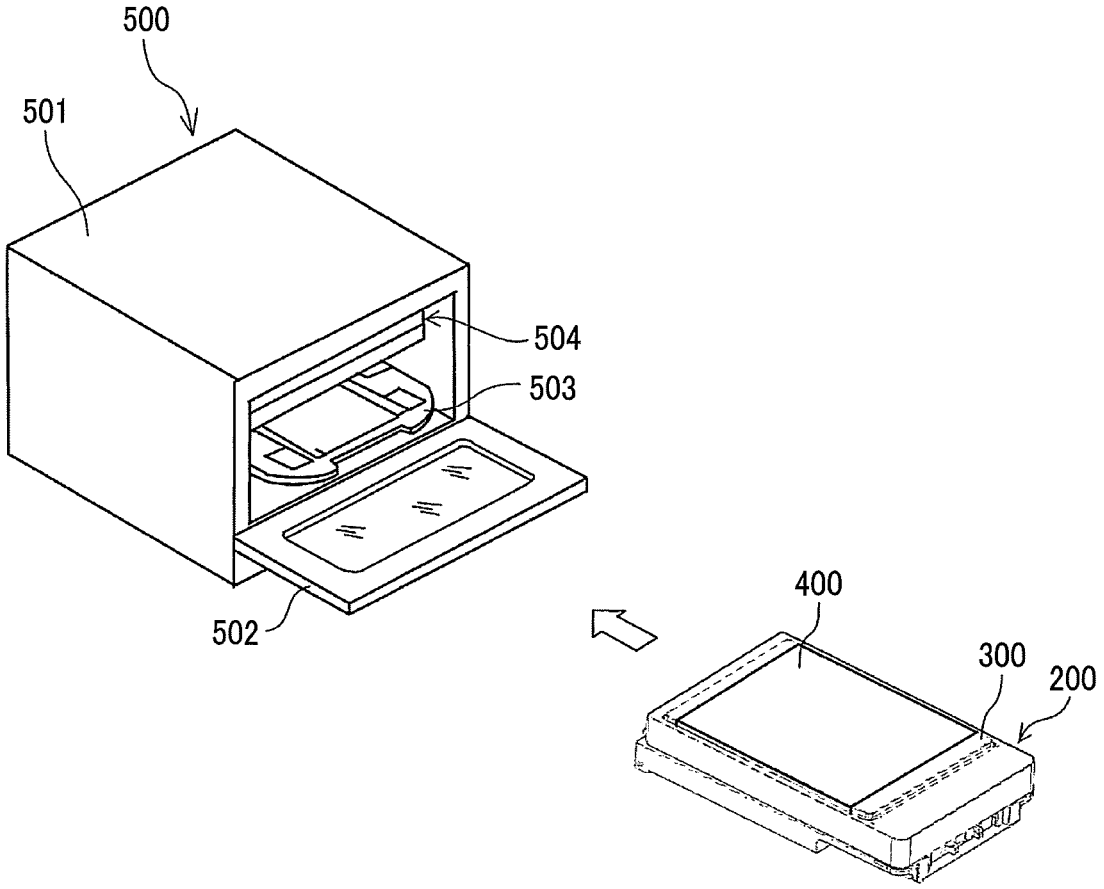
FIG. 16 is an external perspective view of a heating device and the cassette depicted in FIG. 1.

Referring to FIG. 16, a description is provided of one example of a construction of a heating device 500 that heats the cloth 400.

FIG. 16 is an external perspective view of the heating device 500.

As illustrated in FIG. 16, the heating device 500 includes a body 501, a door 502, a receiver 503, and a heater 504. The receiver 503 and the heater 504 are disposed inside the body 501. The cassette 200 that holds the cloth 400 is removably attached to the receiver 503 that holds the cassette 200. The heater 504 heats the cloth 400.

The receiver 503 has a construction equivalent to the above-described construction of the stage 111 of the printer 1. After the printer 1 finishes printing on the cloth 400, the user attaches the cassette 200 mounting the cloth 400 to the receiver 503 inside the heating device 500. Alternatively, the receiver 503 may be a table on which the cassette 200 is placed such that the table holds the cassette 200.

With the above-described construction of the heating device 500, after the printer 1 finishes printing on the cloth 400, the user removes the cassette 200 mounting the cloth 400 from the printer 1. The user sets the cassette 200 mounting the cloth 400 onto the receiver 503 disposed inside the heating device 500. While the door 502 is closed, as power is supplied to the heater 504 to generate heat, the heater 504 heats the cloth 400 set on the cassette 200 and fixes an image on the cloth 400.

A description is provided of processes for forming an image on a cloth 400.

In a holding process, the cassette 200 (e.g., a tray) holds a cloth 400 onto which an image is to be formed.

In a printing process, the cassette 200 mounting the cloth 400 is attached to the stage 111 of the printer 1 and the printer 1 prints the image on the cloth 400. In a heating process, after the printing process, the cassette 200 mounting the cloth 400 is removed from the printer 1 and moved from the printer 1 to the heating device 500. The heating device 500 heats the cloth 400 and fixes the image on the cloth 400.

While the cassette 200 keeps mounting the cloth 400, the printer 1 prints the image on the cloth 400 and the heating device 500 fixes the image on the cloth 400 under heat, enhancing usability in forming the image on the cloth 400.

According to the embodiments described above, each of the cassettes 200, 200S, 200T, 200U, and 200V that has a box shape serves as a cloth holder. Alternatively, the cloth holder may have other shapes as long as the cloth holder is removably attached to a printer and a heating device. For example, the cloth holder may be a single platy platen to be inserted into the printer and the heating device.

As a method to enhance usability for printing, in order to eliminate a process in which the user sets a cloth (e.g., a T-shirt) on the cloth holder every time during printing, the user may use the cloth holder on which the cloth has been set. In this case, the cloth holder after use is collected and the cloth holder on which another cloth has been set is supplied.

Alternatively, in order to attain similar advantages, the user may use a platen on which a cloth (e.g., a T-shirt) has been set. The platen is removably attachable to the cloth holder. For example, the user attaches the platen mounting the cloth to the cloth holder. After printing and fixing are finished, the user removes the platen mounting the cloth from the cloth holder. The user attaches a next platen on which a next cloth has been set to the cloth holder. Printing and fixing are performed on the next cloth set on the next platen. In this case, the platen after use is collected and the platen on which another cloth has been set is supplied.

Accordingly, since the user need not set a cloth (e.g., a T-shirt) on the platen every time, the user readily handles a plurality of clothes continuously. Alternatively, the plurality of clothes may be automatically handled continuously.

The embodiments described above use fabric such as a T-shirt as the cloth 400. Alternatively, the embodiments described above are applicable to media including fabric on which an image is printed and heated. In this case, the cloth 400 used in the embodiments described above serves as a medium.

A description is provided of advantages of a cloth holder (e.g., the cassettes 200, 200S, 200T, 2000, and 200V), serving as each of a first cloth holder and a second cloth holder, which holds fabric.

As illustrated in FIG. 9, a cloth holder stacker (e.g., the cloth holder stacker 2) includes the first cloth holder and the second cloth holder each of which holds a cloth (e.g., the cloth 400). Each of the first cloth holder and the second cloth holder includes a base (e.g., the cassette base 201), a platen (e.g., the platen 300), a flange cover (e.g., the platen flange cover 202), and a clearance former (e.g., the projections 241, 241*a*, and 241*b* and the clearance former 243). The platen holds the cloth and keeps a print portion of the cloth where an image is to be printed to be planar. The platen includes a flange (e.g., the flange 300*a*) that sandwiches the cloth together with the flange cover. The clearance former is mounted on a bottom (e.g., the bottom 201*a*) of the base.

The clearance former of the second cloth holder defines a clearance (e.g., the clearance 600) between the bottom of the base of the second cloth holder and the cloth mounted on the platen of the first cloth holder when the second cloth holder is stacked on the first cloth holder.

Hence, a fabric printing apparatus (e.g., the printer 1) incorporating the first cloth holder or the second cloth holder prints on a plurality of clothes continuously in a small space.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A cloth holder stacker comprising:

a first cloth holder including:

a first base including a first bottom;

a first platen to hold a first cloth; and a first clearance former mounted on the first bottom of the first base; and a second cloth holder including:

a second base including a second bottom;

a second platen to hold a second cloth;

a second clearance former mounted on the second bottom of the second base, the second clearance former to define a clearance between the second bottom of the second base and the first cloth held by the first cloth holder when the second cloth holder is stacked on the first cloth holder;

a first flange cover attached to the first base; and a second flange cover attached to the second base, wherein each of the first clearance former and the second clearance former includes a projection, and wherein each of the first flange cover and the second flange cover includes a recess to engage the projection when the second cloth holder is stacked on the first cloth holder.

2. The cloth holder stacker according to claim 1, wherein the first platen includes a first flange to sandwich the first cloth together with the first flange cover to keep a first print portion of the first cloth where a first image is to be printed to be planar, and wherein the second platen includes a second flange to sandwich the second cloth together with the second flange cover to keep a second print portion of the second cloth where a second image is to be printed to be planar.

3. The cloth holder stacker according to claim 1, wherein the first platen and the second platen project beyond the first flange cover and the second flange cover, respectively.

4. The cloth holder stacker according to claim 1, further comprising:

a magnetic metal disposed on each of the first clearance former and the second clearance former; and a magnet disposed on each of the first flange cover and the second flange cover, the magnet to magnetically attract the magnetic metal, wherein the magnet disposed on the first flange cover of the first cloth holder magnetically attracts the magnetic metal disposed on the second clearance former of the second cloth holder when the second cloth holder is stacked on the first cloth holder.

5. The cloth holder stacker according to claim 4, wherein a height from an upper face of each of the first flange cover and the second flange cover to each of the first cloth and the second cloth is smaller than a height of the projection.

6. The cloth holder stacker according to claim 4, wherein the magnetic metal is embedded in each of the first clearance former and the second clearance former, and wherein the magnet is embedded in each of the first flange cover and the second flange cover.

7. The cloth holder stacker according to claim 1, further comprising:

a magnetic metal mounted on a bottom of the projection; and a magnet mounted on a bottom of the recess.

8. The cloth holder stacker according to claim 1, further comprising:

a magnetic metal mounted on a bottom of the recess; and a magnet mounted on a bottom of the projection.

9. The cloth holder stacker according to claim 1, wherein a height from an interior bottom face of the recess to each of the first cloth and the second cloth is smaller than a height of the projection.

10. The cloth holder stacker according to claim 1, wherein each of the first clearance former and the second clearance former includes:

a first projection having a first height;

a second projection having a second height greater than the first height; and a screw to selectively fasten the first projection and the second projection to each of the first base and the second base.

11. A cloth holder stacker comprising:

a first cloth holder including:

a first base including a first bottom;

a first platen to hold a first cloth; and a first clearance former mounted on the first bottom of the first base;

a second cloth holder including:

a second base including a second bottom;

a second platen to hold a second cloth; and a second clearance former mounted on the second bottom of the second base, the second clearance former to define a clearance between the second bottom of the second base and the first cloth held by the first cloth holder when the second cloth holder is stacked on the first cloth holder;

a first flange cover attached to the first base; and a second flange cover attached to the second base, wherein each of the first clearance former and the second clearance former includes a projection, the cloth holder stacker further comprising:

a magnetic metal disposed on each of the first clearance former and the second clearance former; and a magnet disposed on each of the first flange cover and the second flange cover, the magnet to magnetically attract the magnetic metal, wherein the magnet disposed on the first flange cover of the first cloth holder magnetically attracts the magnetic metal disposed on the second clearance former of the second cloth holder when the second cloth holder is stacked on the first cloth holder.

12. The cloth holder stacker according to claim 11, wherein a height from an upper face of each of the first flange cover and the second flange cover to each of the first cloth and the second cloth is smaller than a height of the projection.

13. The cloth holder stacker according to claim 11, wherein the magnetic metal is embedded in each of the first clearance former and the second clearance former, and wherein the magnet is embedded in each of the first flange cover and the second flange cover.

14. A cloth holder stacker comprising:

a first cloth holder including:

a first base including a first bottom;

a first platen to hold a first cloth; and a first clearance former mounted on the first bottom of the first base;

a second cloth holder including:

a second base including a second bottom;

a second platen to hold a second cloth; and a second clearance former mounted on the second bottom of the second base, the second clearance former to define a clearance between the second bottom of the second base and the first cloth held by the first cloth holder when the second cloth holder is stacked on the first cloth holder;

a first flange cover attached to the first base; and a second flange cover attached to the second base, wherein each of the first clearance former and the second clearance former includes a projection, and the cloth holder stacker further comprising:

a magnetic metal disposed on each of the first flange cover and the second flange cover; and a magnet disposed on each of the first clearance former and the second clearance former, the magnet to magnetically attract the magnetic metal, wherein the magnet disposed on the second clearance former of the second cloth holder magnetically attracts the magnetic metal disposed on the first flange cover of the first cloth holder when the second cloth holder is stacked on the first cloth holder.

* * * * *